US007453206B2

(12) United States Patent
Fujitani et al.

(10) Patent No.: US 7,453,206 B2
(45) Date of Patent: Nov. 18, 2008

(54) PLASMA DISPLAY PANEL AND METHOD FOR INCREASING CHARGE CAPACITY OF A DISPLAY CELL

(75) Inventors: Morio Fujitani, Takatsuki (JP); Hiroyuki Yonehara, Hirakata (JP); Masaki Aoki, Minoo (JP); Keisuke Sumida, Hirakata (JP); Hideki Asida, Settsu (JP); Junichi Hibino, Kyoto (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 10/479,158

(22) PCT Filed: May 27, 2002

(86) PCT No.: PCT/JP02/05100

§ 371 (c)(1),
(2), (4) Date: Jun. 1, 2004

(87) PCT Pub. No.: WO02/097846

PCT Pub. Date: Dec. 5, 2002

(65) Prior Publication Data

US 2004/0212305 A1 Oct. 28, 2004

(30) Foreign Application Priority Data

May 28, 2001 (JP) ..... 2001-158716
May 28, 2001 (JP) ..... 2001-158717

(51) Int. Cl.
*H01J 17/49* (2006.01)

(52) U.S. Cl. ..... 313/582; 313/581

(58) Field of Classification Search ..... 313/582–587, 313/581; 315/169.1
See application file for complete search history.

(56) References Cited

U.S. PATENT DOCUMENTS

| | | | | |
|---|---|---|---|---|
| 5,742,122 | A * | 4/1998 | Amemiya et al. | 313/582 |
| 5,909,083 | A * | 6/1999 | Asano et al. | 313/584 |
| 5,980,347 | A | 11/1999 | Udagawa et al. | |
| 6,255,780 | B1 * | 7/2001 | Komaki et al. | 313/586 |
| 6,339,292 | B1 | 1/2002 | Ha | |
| 6,433,477 | B1 * | 8/2002 | Ha et al. | 313/586 |
| 6,476,554 | B1 * | 11/2002 | Snijkers et al. | 313/586 |
| 6,525,470 | B1 * | 2/2003 | Amemiya | 313/586 |

(Continued)

FOREIGN PATENT DOCUMENTS

EP 0 836 892 4/1998

(Continued)

*Primary Examiner*—Toan Toan
*Assistant Examiner*—Hana A Sanei

(57) ABSTRACT

A PDP has first and second substrates which face each other with a space in between. A display electrode pair and a dielectric layer are formed on the first substrate, and a plurality of discharge cells are formed between the first and second substrates along the display electrode pair. In this construction, two or more depressions are provided in the dielectric layer in an area corresponding to each discharge cell. This improves luminous intensity and illumination efficiency. Also, to form the dielectric layer on the first substrate, first a transfer film is made by providing a dielectric precursor layer on a support film, then depressions are formed in the dielectric precursor layer of the transfer film, and lastly the dielectric precursor layer of the transfer film is transferred onto the first substrate. This decreases the number of manufacturing steps and increases the yield, thereby reducing manufacturing costs.

7 Claims, 11 Drawing Sheets

U.S. PATENT DOCUMENTS

| | | | | |
|---|---|---|---|---|
| 6,531,820 | B1 | 3/2003 | Lee et al. | |
| RE38,357 | E | 12/2003 | Amemiya et al. | |
| 2001/0017520 | A1 * | 8/2001 | Masuda et al. | 313/586 |
| 2003/0151363 | A1 | 8/2003 | Lee et al. | |

FOREIGN PATENT DOCUMENTS

| | | | | |
|---|---|---|---|---|
| EP | 836892 | A2 | * | 4/1998 |
| JP | 8-250029 | | | 9/1996 |
| JP | 9-102273 | | | 4/1997 |
| JP | 9-283017 | | | 10/1997 |
| JP | 10-326562 | | | 12/1998 |
| JP | 11-213904 | | | 8/1999 |
| JP | 11233026 | A | * | 8/1999 |
| JP | 11317171 | A | * | 11/1999 |
| JP | 11-339670 | | | 12/1999 |
| JP | 3033180 | | | 2/2000 |
| JP | 2000133150 | A | * | 5/2000 |
| JP | 2000-285811 | | | 10/2000 |
| JP | 2000-315459 | | | 11/2000 |
| JP | 2001126625 | A | * | 5/2001 |
| JP | 2001-351533 | | | 12/2001 |
| JP | 2002-231127 | | | 8/2002 |
| KR | 2001010400 | A | * | 2/2001 |
| WO | WO 0002225 | A1 | * | 1/2000 |

* cited by examiner

PLASMA DISPLAY PANEL AND METHOD FOR INCREASING CHARGE CAPACITY OF A DISPLAY CELL

TECHNICAL FIELD

The present invention relates to a gas discharge display device for use in a display device or the like, a manufacturing method for the gas discharge display device, and a transfer film used for manufacturing the gas discharge display device.

BACKGROUND ART

In recent years, there have been high expectations for the realization of large-screen, wall-hung televisions as two-way information terminals. In the field of display panels, research is being performed into a variety of devices, such as liquid crystal displays, field emission displays, and electroluminescent displays. Some of these have already been placed on the market, while others are under development.

Of these display devices, plasma display panels (PDPs) are self-luminous type, and enables large-screen televisions with high-quality image display to be realized. Thus, PDPs offer distinctive features which cannot be found in other types of display devices.

Typically, PDPs have a construction in which discharge cells of different colors are arranged in the form of matrix. In the case of surface discharge ac (alternating current) PDPs, a front glass substrate and a back glass substrate are set in parallel with each other with barrier ribs being interposed in between. Display electrode pairs (pairs of scan electrodes and sustain electrodes) are formed in parallel with each other on the front glass substrate. A dielectric glass layer is formed on the front glass substrate so as to cover the display electrode pairs. Meanwhile, address electrodes are formed on the back glass substrate so as to cross over the scan electrodes at right angles. Red, green, and blue phosphor layers are provided in the spaces partitioned by the barrier ribs between the front and back glass substrates. A discharge gas is enclosed in these spaces. Hence a panel construction where discharge cells of different colors are formed is obtained.

To drive such a PDP, a voltage is applied to each electrode using a drive circuit. This causes discharge to occur in the discharge cells, which emit ultraviolet light. The ultraviolet light excites phosphor particles (red, green, and blue) in the phosphor layers to emit light. Hence an image is displayed.

To achieve high image quality in the PDP, it is necessary to adjust the amount of light emitted in each colored cell so that a high color temperature can be obtained when white is being displayed. Generally, the light intensity of a blue phosphor is weaker than the other two colors. Accordingly, in conventional PDPs adjustments are made using drive circuits to make the discharge in the blue cells larger than the discharge in the other colored cells. In so doing, the amount of light emission for each color is balanced.

Also, it is important for PDPs to display images at high luminance with low power consumption.

To achieve high luminance, it may be effective to increase discharge intensity by reducing the film thickness of the dielectric layer. However, just making the dielectric layer thinner does not have an effect of improving the illumination efficiency of the phosphor layers, but rather tends to cause a drop in illumination efficiency.

DISCLOSURE OF INVENTION

The first object of the present invention is to provide a PDP with improved luminous intensity and illumination efficiency.

The second object of the present invention is to provide a PDP that can balance the amount of light emission for each color so that a high color temperature is obtained when white is being displayed, without having to make adjustments using drive circuits.

The first object can be achieved by a plasma display panel including: a first panel including a first substrate, a display electrode pair formed on a surface of the first substrate, and a dielectric layer formed on the surface of the first substrate so as to cover the display electrode pair; and a second panel including a second substrate and phosphor layers formed on a surface of the second substrate, wherein the first panel and the second panel are set so that the surface of the first substrate on which the display electrode pair and the dielectric layer have been formed faces the surface of the second substrate on which the phosphor layers have been formed, with a plurality of discharge cells being formed between the first panel and the second panel along the display electrode pair, wherein a surface of the dielectric layer facing the second panel has at least two depressions which include a first depression and a second depression, in an area that corresponds to each discharge cell.

In a conventional PDP, strong discharge tends to gather near the discharge gap between the pair of display electrodes. This often causes the luminance of the phosphor to become saturated near the discharge gap, which leads to a degrease in illumination efficiency.

According to the above construction, however, the capacity of the discharge cell increases locally in each depression, so that a relatively large charge is formed in each depression when a voltage is applied to the display electrodes. As a result, discharge starts not only in the vicinity of the discharge gap but in each depression, which allows strong discharge to spread across the discharge cell. Hence the phosphor luminance saturation can be avoided.

Thus, not only the discharge firing voltage is decreased but also the discharge starting point is decentralized in the discharge cell, with it being possible to improve luminous intensity and illumination efficiency.

For example, the depressions can be formed on the surface of the dielectric layer using any of the following preferable patterns.

Here, the surface of the dielectric layer may be mat-texturized.

Here, the first depression and the second depression may be separated on opposite sides of a center line of the discharge cell, the center line running along and being positioned between the display electrode pair.

Here, a first channel and a second channel that extend over the plurality of discharge cells may be formed on the surface of the dielectric layer along the display electrode pair, wherein a part of the first channel and a part of the second channel are respectively the first depression and the second depression.

Here, the first channel and the second channel may each be shaped like one of an undulating line and a zigzag line.

Here, the first depression and the second depression may be isolated from other first and second depressions provided in other discharge cells.

Here, the first depression and the second depression may each be shaped like one of a U and a V, wherein the first depression and the second depression are positioned with open ends or closed ends thereof facing each other.

Here, the first depression and the second depression may be closer to each other in a vicinity of a center of the discharge cell, and farther from each other as the first depression and the second depression become more distant from the center of the discharge cell in a direction along the display electrode pair.

Here, the first depression and the second depression may be separated on opposite sides of a center line of the discharge cell, the center line running along a direction orthogonal to the display electrode pair.

Here, a first channel and a second channel that extend over a plurality of discharge cells may be formed on the surface of the dielectric layer along the direction orthogonal to the display electrode pair, wherein a part of the first channel and a part of the second channel are respectively the first depression and the second depression.

Here, the first depression and the second depression may be isolated from other first and second depressions provided in other discharge cells.

Here, at least one of the first depression and the second depression may have regions that differ in depth.

The second object can be achieved by the PDP of the above construction wherein each discharge cell corresponds to a phosphor layer of a color selected from a plurality of colors, and the first depression and the second depression have a shape that differs according to the color of the phosphor layer corresponding to the discharge cell.

This can be done using any of the following preferable patterns.

Here, the plurality of colors may include red, green, and blue, wherein a total area of the first depression and the second depression increases in an order of red, green, and blue.

Here, the plurality of colors may include red, green, and blue, wherein a distance between the first depression and the second depression increases in an order of red, green, and blue.

The first object can also be achieved by a plasma display panel including: a front panel having a front substrate, a display electrode pair formed on a surface of the front substrate, and a dielectric layer formed on the surface of the front substrate so as to cover the display electrode pair; and a back panel having a back substrate which is set facing the surface of the front substrate on which the display electrode pair and the dielectric layer have been formed, with a plurality of discharge cells being formed between the front panel and the back panel along the display electrode pair, wherein an area of the front panel that corresponds to each discharge cell has a transmitting region and a blocking region, the transmitting region allowing visible light generated in the discharge cell to pass through, and the blocking region blocking the visible light from passing through, and the dielectric layer has a thickness that is varied so as to change a direction of a light flux which is generated in the discharge cell and is directed toward the blocking region, to the transmitting region.

Here, the dielectric layer may be formed like a lens that concentrates light generated in the discharge cell, not to the blocking region but to the transmitting region.

The third object of the present invention is to manufacture the PDP whose dielectric layer is provided with the above depressions at low cost, by reducing the number of manufacturing steps and increasing yields.

The third object can be achieved by a manufacturing method for a plasma display panel that includes: a first process of forming a dielectric layer on a surface of a first substrate so as to cover a plurality of display electrode pairs which have been formed on the surface of the first substrate; and a second process of setting a second substrate facing the surface of the first substrate on which the plurality of display electrode pairs and the dielectric layer have been formed, the first process including the steps of: making a transfer film by forming a dielectric precursor layer on a support film; forming depressions in the dielectric precursor layer of the transfer film; and transferring the dielectric precursor layer of the transfer film in which the depressions have been formed, onto the surface of the first substrate.

The third object can also be achieved by a manufacturing method for a plasma display panel that includes: a first process of forming a dielectric layer on a surface of a first substrate so as to cover a plurality of display electrode pairs which have been formed on the surface of the first substrate; and a second process of setting a second substrate facing the surface of the first substrate on which the plurality of display electrode pairs and the dielectric layer have been formed, the first process including the steps of: making a transfer film by forming a dielectric precursor layer on a support film; transferring the dielectric precursor layer of the transfer film onto the surface of the first substrate; and forming depressions in the dielectric precursor layer transferred on the surface of the first substrate.

Note here that "forming depressions in the dielectric precursor layer" means to vary the thickness of the dielectric precursor layer for each part.

Here, in the depression forming step, the depressions may be formed by pressing a unit having projections against the transfer film.

Though the unit can be shaped like any of a flat plate and a roller, the roller shape is more preferable as it allows depressions to be successively formed with uniform depth even if the thickness of the first substrate or dielectric precursor layer is not uniform.

The third object can also be achieved by a transfer film used for forming a dielectric layer of a plasma display panel, including: a support film; and a dielectric precursor layer which is formed on the support film, the dielectric precursor layer being made up of a dielectric precursor which includes a glass powder and a resin, wherein depressions are formed in the dielectric precursor layer in an area that corresponds to each discharge cell of the plasma display panel.

The transfer film can be manufactured using a manufacturing method for a transfer film that is used for forming a dielectric layer of a plasma display panel, including the steps of: forming a dielectric precursor layer on a support film, the dielectric precursor layer being made up of a dielectric composite which includes a glass powder and a resin; and forming depressions in the dielectric precursor layer.

In the above manufacturing method, the depressions can be easily formed in the dielectric precursor layer using a laminating device for laminating a transfer film onto a substrate, the transfer film including a dielectric precursor layer that is used for forming a dielectric layer of a plasma display panel, including: a roller which has projections for forming depressions in the dielectric precursor layer.

Also, the depressions can be easily formed using a transfer film making device for forming, on a support film, a dielectric precursor layer that is used for forming a dielectric layer of a plasma display panel, including: a roller which has projections for forming depressions in the dielectric precursor layer.

Also, the depressions can be easily formed using a device for removing a film that covers a dielectric precursor layer which is used for forming a dielectric layer of a plasma display panel, the dielectric precursor layer being made up of a dielectric precursor which includes a glass powder and a resin, including: a roller which has projections for forming depressions in the dielectric precursor layer.

BEST MODE FOR CARRYING OUT THE INVENTION

The following is a description of the embodiments of the present invention with reference to drawings. It should be noted here that the following embodiments and drawings are mere examples and so the present invention is not limited to such.

Figure 1:
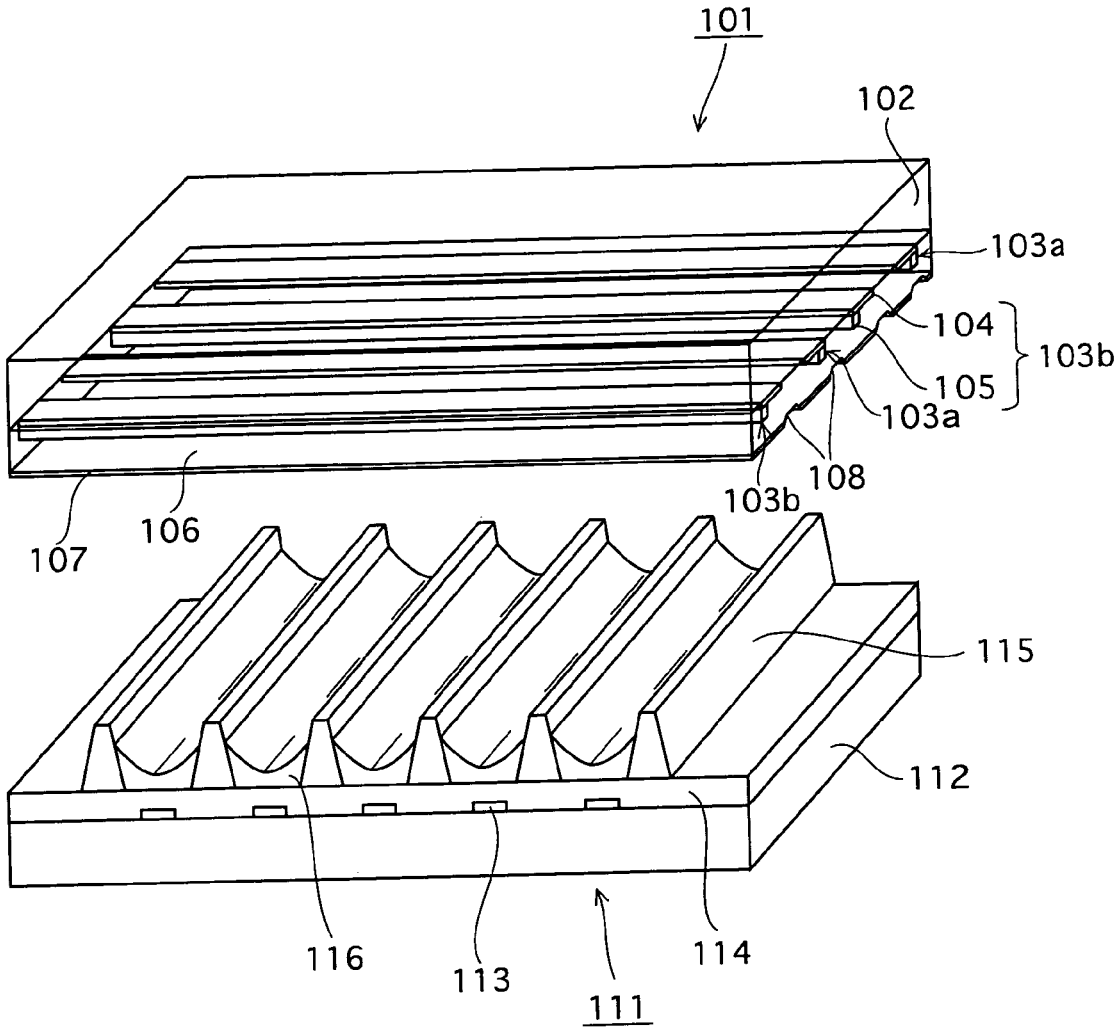
FIG. 1 is a perspective view showing the essential part of a PDP to which the embodiments of the present invention relate.

FIG. 1 is a perspective view showing the essential part of a surface discharge ac PDP to which the embodiments of the present invention relate.

The PDP has a construction in which a front panel 101 and a back panel 111 are set in parallel with each other with a gap in between.

In the front panel 101, display electrode pairs (first display electrodes 103*a* and second display electrodes 103*b*), a dielectric layer 106, and a protective layer 107 are provided in this order on the surface of a front glass substrate 102 that faces the back panel 111. In the back panel 111, address electrodes 113 as second electrodes, a dielectric layer 114, and barrier ribs 115 are provided in this order on the surface of a back glass substrate 112 that faces the front panel 101. Also, phosphor layers 116 are provided between adjacent barrier ribs 115. These phosphor layers 116 are arranged in the form of alternating red, green, and blue stripes.

The front panel 101 and the back panel 111 are sealed together using a peripheral sealing member (not illustrated). The gap between the front panel 101 and the back panel 111 is divided by the stripe-shaped barrier ribs 115 to form discharge spaces. A discharge gas is enclosed in these discharge spaces.

Figure 2:
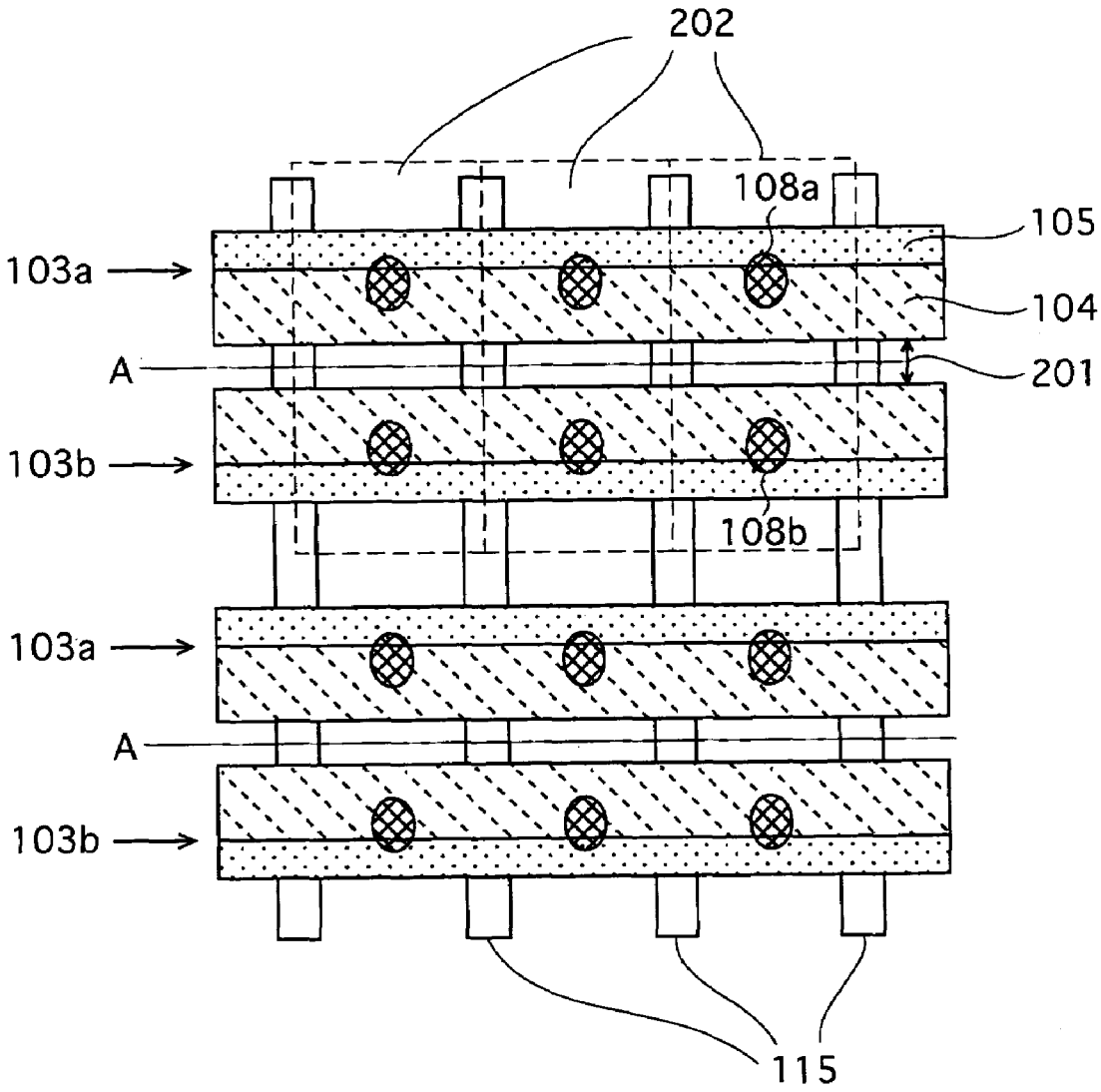
FIG. 2 shows a state where display electrode pairs, address electrodes, and barrier ribs are arranged.

FIG. 2 shows a state where the pairs of display electrode 103*a* and 103*b*, the address electrodes 113, and the barrier ribs 115 are arranged.

The pairs of display electrodes 103*a* and 103*b* are provided in stripes along the row direction of the matrix display. In the drawing, a line A represents the center line of the gap (discharge gap) 201 between the display electrodes 103*a* and 103*b*.

On the other hand, the barrier ribs 115 and the address electrodes 113 are formed in stripes along the column direction of the matrix display.

The areas where the pairs of display electrodes 103*a* and 103*b* cross over the address electrodes 113 are discharge cells (light-emission units) 202 that emit light in the three colors red, green, and blue.

Each of the display electrodes 103*a* and 103*b* can be formed using only a metal of low resistance (e.g. Cr/Cu/Cr or Ag). As an alternative, each display electrode may be formed by forming a narrow bus electrode 105 on a wide transparent electrode 104 which is made of a conductive metal oxide such as ITO, $SnO_2$, or ZnO, as shown in FIG. 2. To secure a wide discharge area within each discharge cell, it is preferable to use wide transparent electrodes for the display electrodes. However, when the cell structure is fine, the width between the pair of display electrodes 103*a* and 103*b* needs to be small, such as 50 μm or below. In this case, it is more preferable to form the display electrodes using only metal electrodes.

The dielectric layer 106 is a layer made of a dielectric material, and is formed over the entire surface of the front glass substrate 102 on which the display electrodes 103*a* and 103*b* have been arranged. While low-melting point lead glass is often used for this dielectric layer 106, bismuth low-melting point glass or a laminate of lead glass with a low-melting point and bismuth glass with a low-melting point may be used.

The protective layer 107 is a thin layer of magnesium oxide (MgO), and covers the entire surface of the dielectric layer 106 that faces the discharge spaces.

In the back panel 111, the address electrodes 113 are formed using silver electrode films.

The dielectric layer 114 is similar to the dielectric layer 106, except that a powder of $TiO_2$ is mixed in the dielectric layer 114 which thereby serves as a reflective layer that reflects visible light.

The barrier ribs 115 are formed from a glass material, and are projected from the surface of the dielectric layer 114 in the back panel 111.

The following materials are used to form the phosphor layers 116:

Blue phosphor: $BaMgAl_{10}O_{17}$:Eu

Green phosphor: $Zn_2SiO_4$:Mn

Red phosphor: $(Y,Gd)BO_3$:Eu

A PDP display device is constructed by connecting drive circuits (not illustrated) to the pairs of display electrodes 103*a* and 103*b* and address electrodes 113 of this PDP. Address discharge pulses are applied to display electrodes 103*a* and address electrodes 113 using the drive circuits, to accumulate a wall charge in the cells which should be illuminated. After this, sustain discharge pulses are applied to the pairs of display electrodes 103*a* and 103*b* to cause sustain discharge in the cells where the wall charge has accumulated. These operations are repeated to display an image.

Here, the dielectric layer 106 has a nonuniform thickness.

This is explained in detail using the first to third embodiments below.

FIRST EMBODIMENT

In the first embodiment, a plurality of depressions 108 are formed on the surface of the dielectric layer 106 in an area that corresponds to each discharge cell 202. This being so, the protective layer 107 covers the entire surface of the dielectric layer 106 including the inner walls of the plurality of depressions 108.

By providing the plurality of depressions 108 on the surface of the dielectric layer 106 in an area corresponding to each discharge cell 202, the capacity of the discharge cell 202 increases locally at these depressions 108. Which is to say, the dielectric layer 106 is relatively thin where the depressions 108 are provided, which allows the capacity of the discharge cell 202 to increase locally. Accordingly, when a voltage is applied between the display electrode 103*a* and address electrode 113 that correspond to the discharge cell 202, a relatively large charge is formed in the depressions 108.

When such a large charge has been locally formed, discharge can be started even if a voltage that is applied between the pair of display electrodes 103*a* and 103*b* is relatively small.

Also, the plurality of depressions 108 are formed on the surface of the dielectric layer 106 within the discharge area of each discharge cell 202. This improves illumination efficiency for the following reason.

In a conventional PDP, discharge usually starts in the vicinity of the discharge gap in each discharge cell. Therefore, strong discharge tends to gather near the discharge gap. This often causes the luminance of the phosphor in the discharge cell to become saturated in the vicinity of the discharge gap (i.e. the phosphor layer that has not yet finished emitting light is attached by ultraviolet light generated by the next discharge, which hinders effective use of ultraviolet light). This causes a drop in illumination efficiency.

Here, if the thickness of the dielectric layer is reduced entirely or in part corresponding to the vicinity of the discharge gap, the discharge firing voltage can be decreased but strong discharge cannot be prevented from gathering in the vicinity of the discharge gap. Besides, the discharge intensity increases. This causes the likelihood of phosphor luminance saturation to increase.

In the case of the dielectric layer 106, on the other hand, a large amount of charge is locally formed in each of the plurality of depressions 108 which are provided within the discharge area of each discharge cell 202, so that discharge starts in each of these depressions 108.

In other words, the discharge starting point is decentralized within the discharge area, which alleviates the concentration of strong discharge in the vicinity of the discharge gap 201. Hence the luminance saturation of the phosphor can be avoided.

Thus, with the provision of the dielectric layer 106, not only the discharge firing voltage can be lowered, but also the discharge starting point can be decentralized within the discharge area. This greatly improves luminous intensity and illumination efficiency.

As can be seen from FIG. 2, the barrier ribs 115 are arranged so as to be orthogonal to the direction in which the pairs of display electrodes 103*a* and 103*b* extend, and the discharge cells 202 are longer in the direction in which the barrier ribs 115 extend.

This being the case, suppose a plurality of depressions (a first depression 108*a* and a second depression 108*b*) are provided in each discharge cell 202 on opposite sides of the center line A, namely, on the display electrode 103*a* side and on the display electrode 103*b* side. This construction is preferable, as the discharge starting point is distributed in the longitudinal direction of the discharge cell 202.

(Patterns of the Depressions)

The following describes various patterns of the plurality of depressions 108 which are formed in the dielectric layer 106 in an area corresponding to each discharge cell 202.

Figure 3:
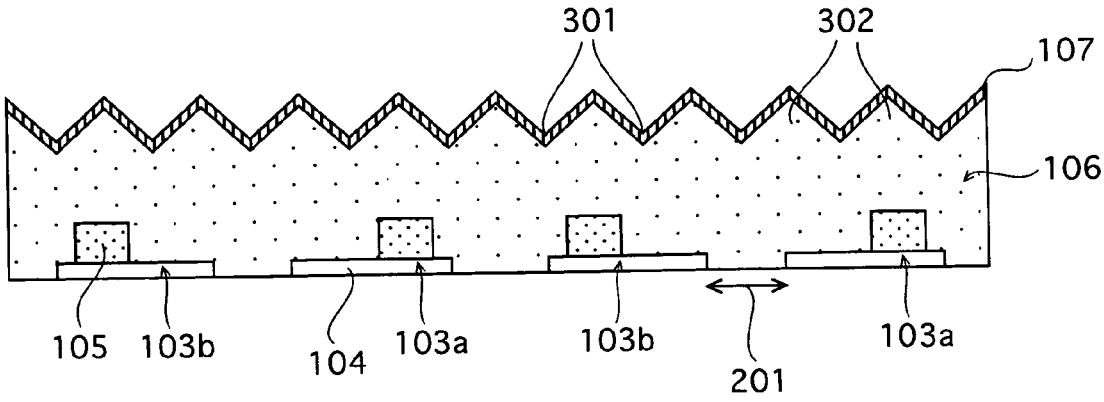
FIG. 3 is a sectional view showing an example where the surface of a dielectric layer is texturized.

FIG. 3 shows an example where the surface of the dielectric layer 106 is texturized.

Figure 4:
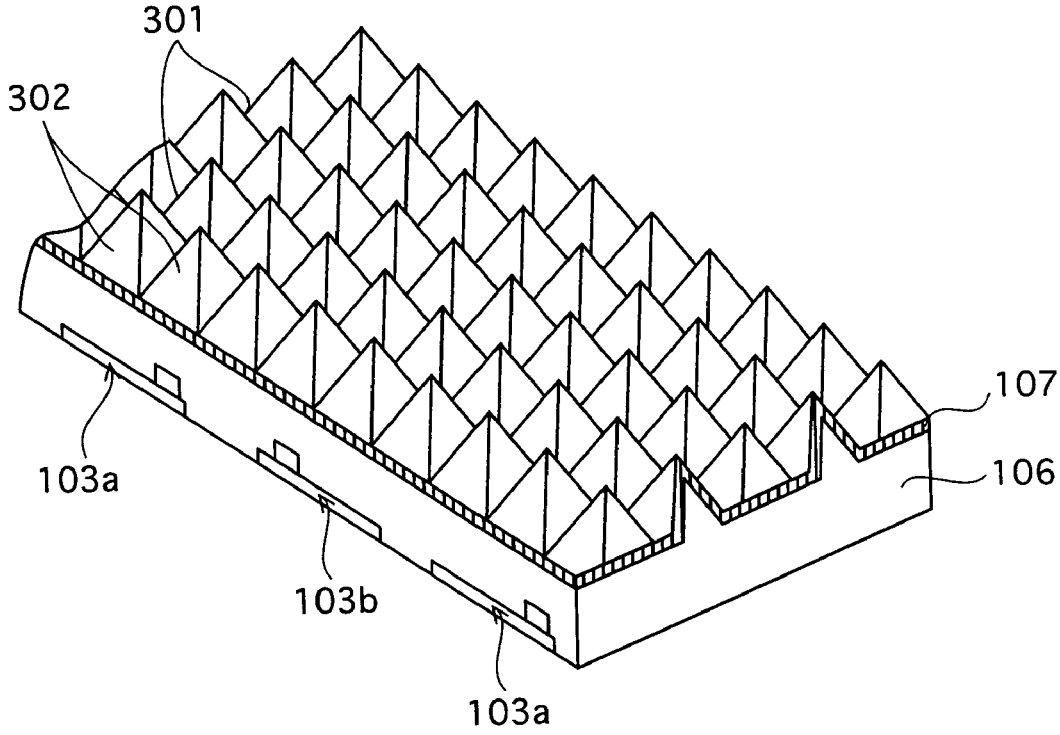
FIG. 4 is a perspective view showing an example where the surface of the dielectric layer is texturized.

In general, a "texture structure" is a structure that contains pyramidal projections or depressions. For example, the surface of the dielectric layer 106 may be provided with pyramidal projections 302 in the form of matrix with depressions 301 being formed between adjacent projections 302, as shown in FIG. 4. On the other hand, the surface of the dielectric layer 106 may be provided with pyramidal depressions in the form of matrix with projections being formed between adjacent depressions. Also, the surface of the dielectric layer 106 may have a mixture of both patterns.

Note here that the shape of such projections or depressions is not limited to a pyramid. For instance, they may be shaped like a hemisphere.

Also, the projections or depressions do not need to have a uniform size. They may have different sizes.

The height of the projections or the depth of the depressions is preferably 1 to 30 μm, more preferably 5 to 20 μm, and further more preferably 5 to 10 μm.

Though the entire surface of the dielectric layer 106 is texturized without any gap in FIG. 3, the surface of the dielectric layer 106 may be texturized in isolation in an individual area that corresponds to each discharge cell 202.

When the surface of the dielectric layer 106 is texturized as described above, many discharge starting points are distributed within each discharge cell 202.

Accordingly, discharge starts not only in a center area but in peripheral areas in the discharge cell 202. Also, once the discharge has started, it spreads fast through the depressions 301. This enables strong discharge to spread evenly across a wide range within the discharge cell 202.

These effects will not be lost even if there are some displacements between the display electrodes 103*a* and 103*b* and the depressions 301. It is therefore not necessary to perform a precise alignment between the display electrodes 103*a* and 103*b* and the depressions 301. This eases the manufacturing process.

Next describes a pattern where channels are formed across a plurality of discharge cells, with parts of these channels serving as depressions.

FIGS. 5A to 5E respectively show examples where pairs of channels 401*a* and 401*b* to 405*a* and 405*b* extending over a plurality of discharge cells are formed in the dielectric layer 106.

Each of the channels 401*a* and 401*b* to 405*a* and 405*b* shown in these drawings extends along the display electrodes (row electrodes) 103*a* and 103*b*.

This being so, parts of each pair of channels correspond to the depressions 108 in each discharge cell 202.

Figure 5A:
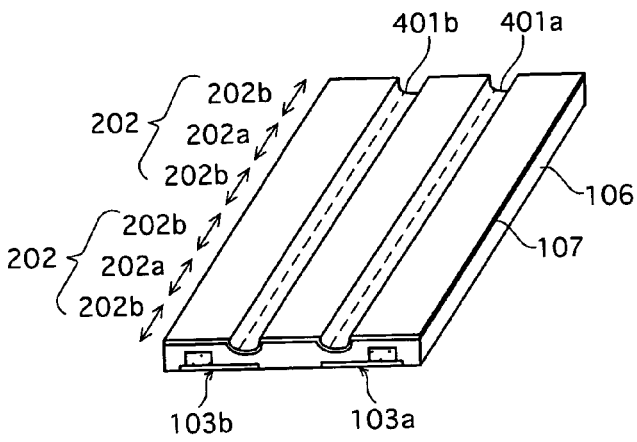
FIGS. 5A through 5E show examples where channels that extend over a plurality of discharge cells are formed in the dielectric layer.

Here, the channels 401*a* and 401*b* shown in FIG. 5A are straight lines parallel to the discharge electrodes 103*a* and 103*b*. Therefore, the distance between the channel 401*a* and the channel 401*b* is the same in a center area 202*a* and peripheral areas 202*b* of each discharge cell 202 in the row direction.

On the other hand, the channels 402*a* and 402*b* to 405*a* and 405*b* shown in FIGS. 5B to 5E are all curved. These channels have the following features.

Figure 5B:
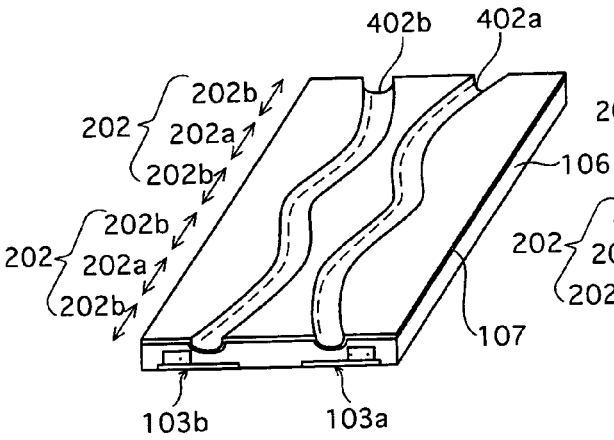
Figure 5C:
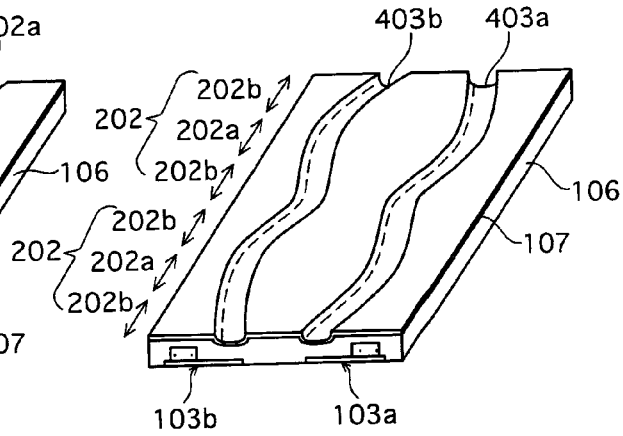
Figure 5D:
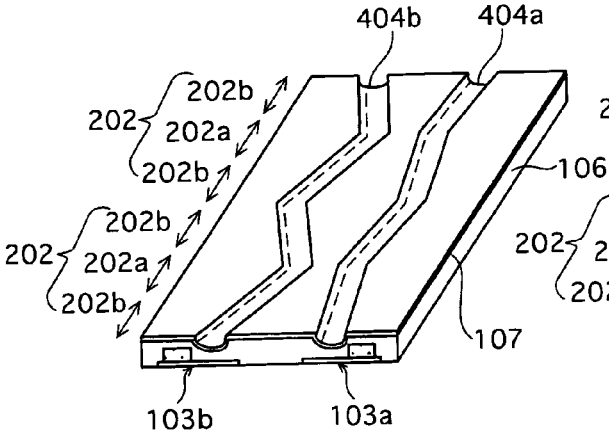

The channels 402*a* and 402*b* shown in FIG. 5B and the channels 404*a* and 404*b* shown in FIG. 5D are shaped so as to be closer to each other in the center area 202*a*, and farther from each other in the peripheral areas 202*b*.

In this case, because the channels are closer to each other near the center area 202*a* that corresponds to the discharge gap, discharge starts near the center area 202*a*, but strong discharge spreads along the channels toward the peripheral areas 202*b*.

Figure 5E:
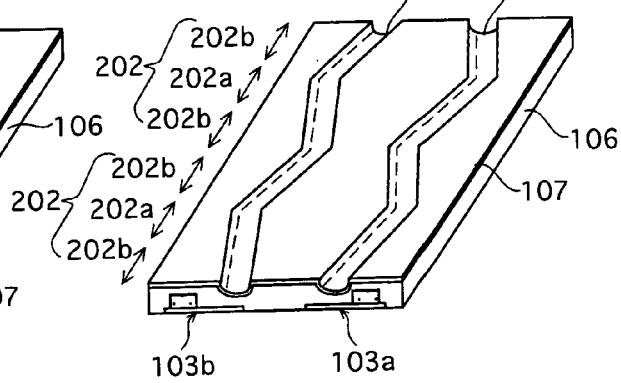

Meanwhile, the channels 403*a* and 403*b* shown in FIG. 5C and the channels 405*a* and 405*b* shown in FIG. 5E are farther from each other in the center area 202*a*, and closer to each other in the peripheral areas 202*b*.

In this case, because the channels are farther from each other near the center area 202*a* that corresponds to the discharge gap, discharge starts not only in the center area 202*a* but also in the peripheral areas 202*b*. Thus, the discharge starting point is distributed widely across the discharge cell 202.

Also, the channels 402*a* and 402*b* in FIG. 5B and the channels 403*a* and 403*b* in FIG. 5C are shaped like an undulating line with wavelike curves, whereas the channels 404*a* and 404*b* in FIG. 5D and the channels 405*a* and 405*b* in FIG. 5E are shaped like a zigzag.

Though each channel shown in FIGS. 5A-5E has a uniform width in the center area 202*a* and in the peripheral areas 202*b*, the width may vary between the center area 202*a* and the peripheral areas 202*b*.

Next describes a pattern where a plurality of depressions are formed in isolation for each discharge cell 202.

FIGS. 6A to 6E respectively show pairs of depressions 501*a* and 501*b* to 505*a* and 505*b* which are provided independently for each discharge cell 202. Note that these drawings show only a part that corresponds to one discharge cell 202.

Figure 6A:
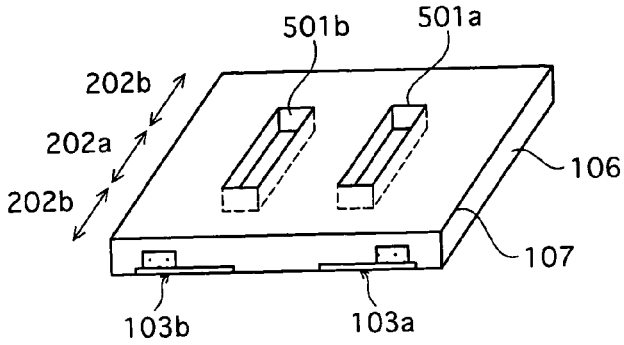
FIGS. 6A through 6E show examples where a first depression and a second depression are formed in the dielectric layer separately for each individual discharge cell.

The depressions 501*a* and 501*b* shown in FIG. 6A are straight lines parallel to the discharge electrodes 103*a* and 103*b*. Therefore, the distance between the depressions 501*a* and 501*b* is the same in the center area 202*a* and in the peripheral areas 202*b*, like the channels 401*a* and 401*b* shown in FIG. 5A.

On the other hand, the depressions 502*a* and 502*b* to 505*a* and 505*b* shown in FIGS. 6B-6E are U-shaped or V-shaped. Accordingly, the distance between each of these pairs of depressions varies between the center area 202*a* and the peripheral areas 202*b*.

Figure 6B:
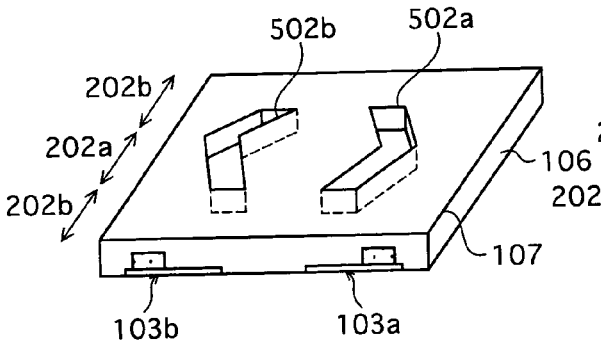
Figure 6C:
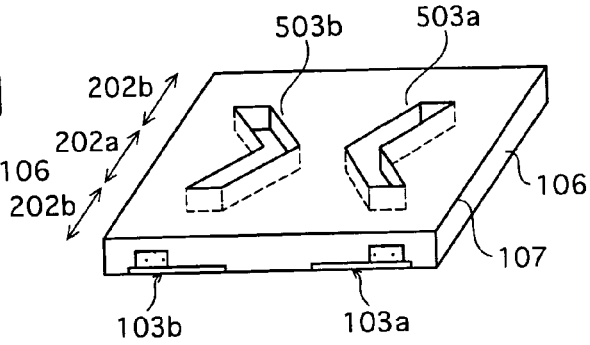
Figure 6D:
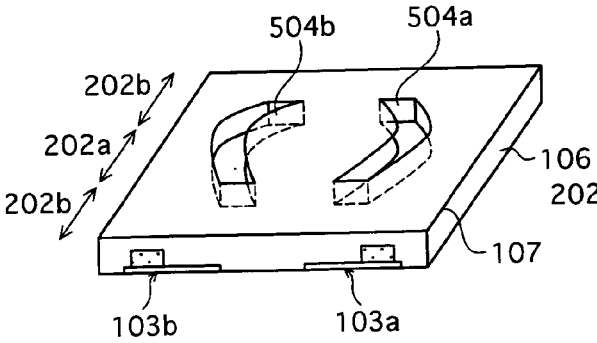

The depressions 502*a* and 502*b* in FIG. 6B and the depressions 504*a* and 504*b* in FIG. 6D have a U or V shape, and are arranged so that their open ends face each other.

In this case, the depressions are farther from each other in the center area 202*a* and closer to each other in the peripheral areas 202*b*, like the channels 403*a* and 403*b* and channels 405*a* and 405*b* shown in FIGS. 5C and 5E. Therefore, discharge starts not only in the center area 202*a* but also in the peripheral areas 202*b*. This allows strong discharge to spread widely across the discharge cell 202.

Figure 6E:
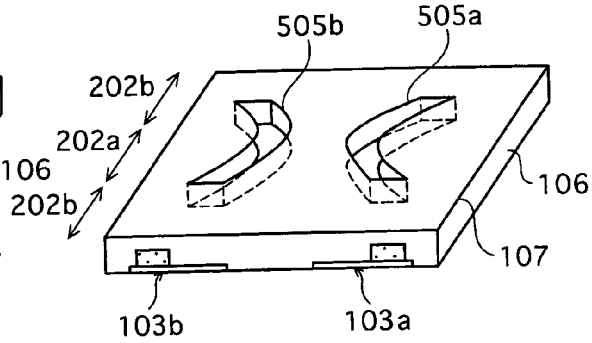

The depressions 503*a* and 503*b* in FIG. 6C and the depressions 505*a* and 505*b* in FIG. 6E have a U or V shape, and are arranged so that their closed ends face each other.

In this case, the depressions are closer to each other in the center area 202*a* and farther from each other in the peripheral areas 202*b*, like the channels 402*a* and 402*b* and channels 404*a* and 404*b* shown in FIGS. 5B and 5D. Accordingly, discharge starts in the center area 202*a*, but then strong discharge spreads along the depressions toward the peripheral areas 202*b*.

While the depressions are shaped like a straight line, a U, or a V in FIG. 6, they may instead be shaped like a circle, an ellipse, a triangle, a rhombus, a polygon, a Y, or a T. Also, two depressions that form a pair do not need to have the same shape.

The above description deals with the case where the depressions are separated on the display electrode 103*a* side and on the display electrode 103*b* side as shown by the first and second depressions 108*a* and 108*b* in FIG. 2. However, they may be distributed in the direction in which the display electrodes 103*a* and 103*b* extend. In such a case, the discharge starting point is distributed in the direction orthogonal to the longitudinal direction of the discharge cell 202. This also has a certain effect of improving luminous intensity and illumination efficiency.

Though FIGS. 5 and 6 show examples where two depressions are provided in each discharge cell, similar effects can be achieved by providing three or more depressions in each discharge cell.

(Depth of the Depressions)

If the depressions shown in FIGS. 5 and 6 are too shallow, a charge cannot be formed locally in the depressions. If the depressions are too deep, on the other hand, it is difficult to perform addressing. Accordingly, the depth of the depressions is preferably 5 to 50 μm, more preferably 10 to 40 μm, and further more preferably 20 to 30 μm.

Also, each of the depressions may have a uniform depth. However, by partially varying the depression in depth, it is possible to change the discharge intensity and control the pattern in which discharge occurs.

For example, by making part of a depression deeper, discharge can be induced easily in that part.

SECOND EMBODIMENT

In the second embodiment, depressions are formed on the surface of the dielectric layer 106 in an area corresponding to each discharge cell 202, so as to assume a different form according to the color of the discharge cell 202.

Figure 7A:
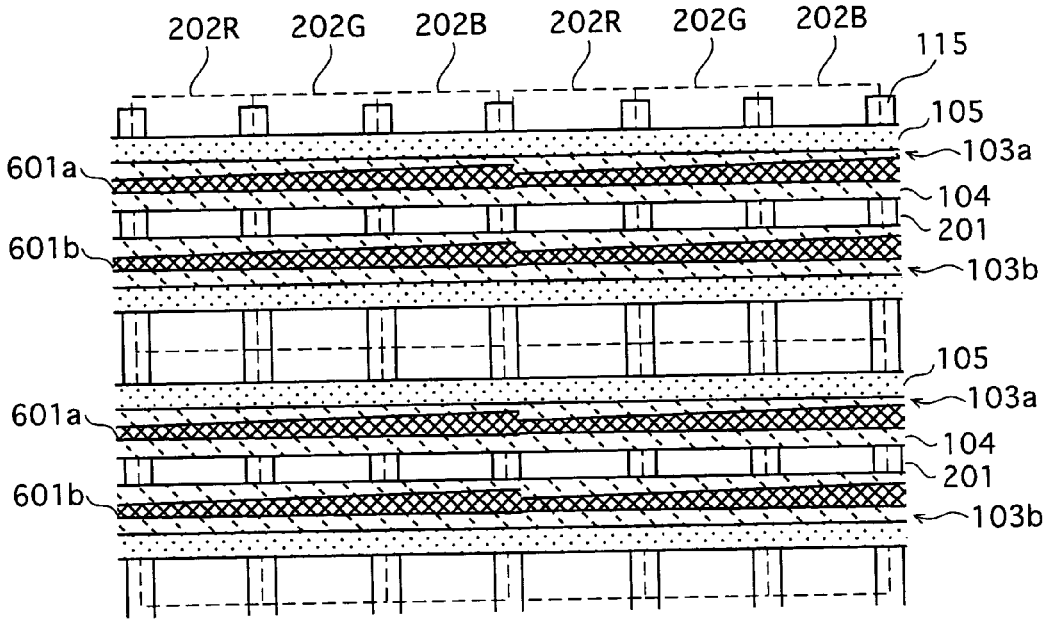
FIGS. 7A and 7B show examples where depressions are formed in the dielectric layer differently for discharge cells of different colors of red, green, and blue.
Figure 7B:
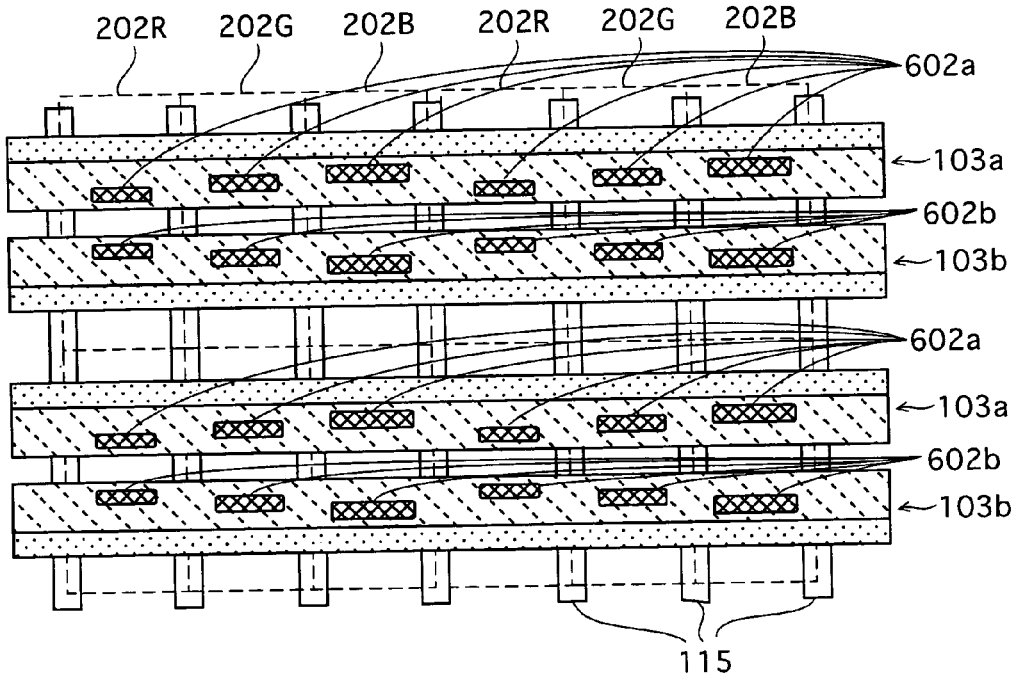

FIG. 7A shows channels 601*a* and 601*b* which are formed in the dielectric layer 106 in parallel with the display electrodes 103*a* and 103*b*. Here, each of the channels 601*a* and 601*b* has a width that increases in the order of a red discharge cell 202R, a green discharge cell 202G, and a blue discharge cell 202B. FIG. 7B shows isolated depressions 602*a* and 602*b* whose areas increase in the order of the red discharge cell 202R, the green discharge cell 202G, and the blue discharge cell 202B.

In both cases, the area (volume) of the depressions increases in the order of the red discharge cell 202R, the green discharge cell 202G, and the blue discharge cell 202B.

The spread of discharge that occurs in each discharge cell 202 when a voltage is applied between the display electrodes 103*a* and 103*b* is greater if the depression area (volume) is larger. Accordingly, by adjusting the depression area (volume) as described above, the spread of discharge can be increased in the order of the red discharge cell 202R, the green discharge cell 202G, and the blue discharge cell 202B.

Of red, green, and blue, blue light has the shortest wavelength, and has the largest energy even when the intensity is the same as red and green light. Therefore, when ultraviolet light is applied to the red, green, and blue phosphors under the same conditions, the blue phosphor cannot deliver the same level of light intensity as the other colored phosphors.

This being so, if the depression area (volume) is varied as shown in FIGS. 7A and 7B, the amount of light emission for each color can be balanced.

In other words, by compensating the smaller light emission amount of the blue discharge cell, the color temperature when white is being displayed can be increased.

A technique for increasing the color temperature by changing the gap between neighboring barrier ribs (cell pitch) according to color is known as a conventional method for balancing the light emission amounts of the three colors. However, if the depression area (volume) is adjusted in the above way, the light emission amounts of the three colors can be balanced even if the cell pitch is uniform for the three colors.

Figure 8:
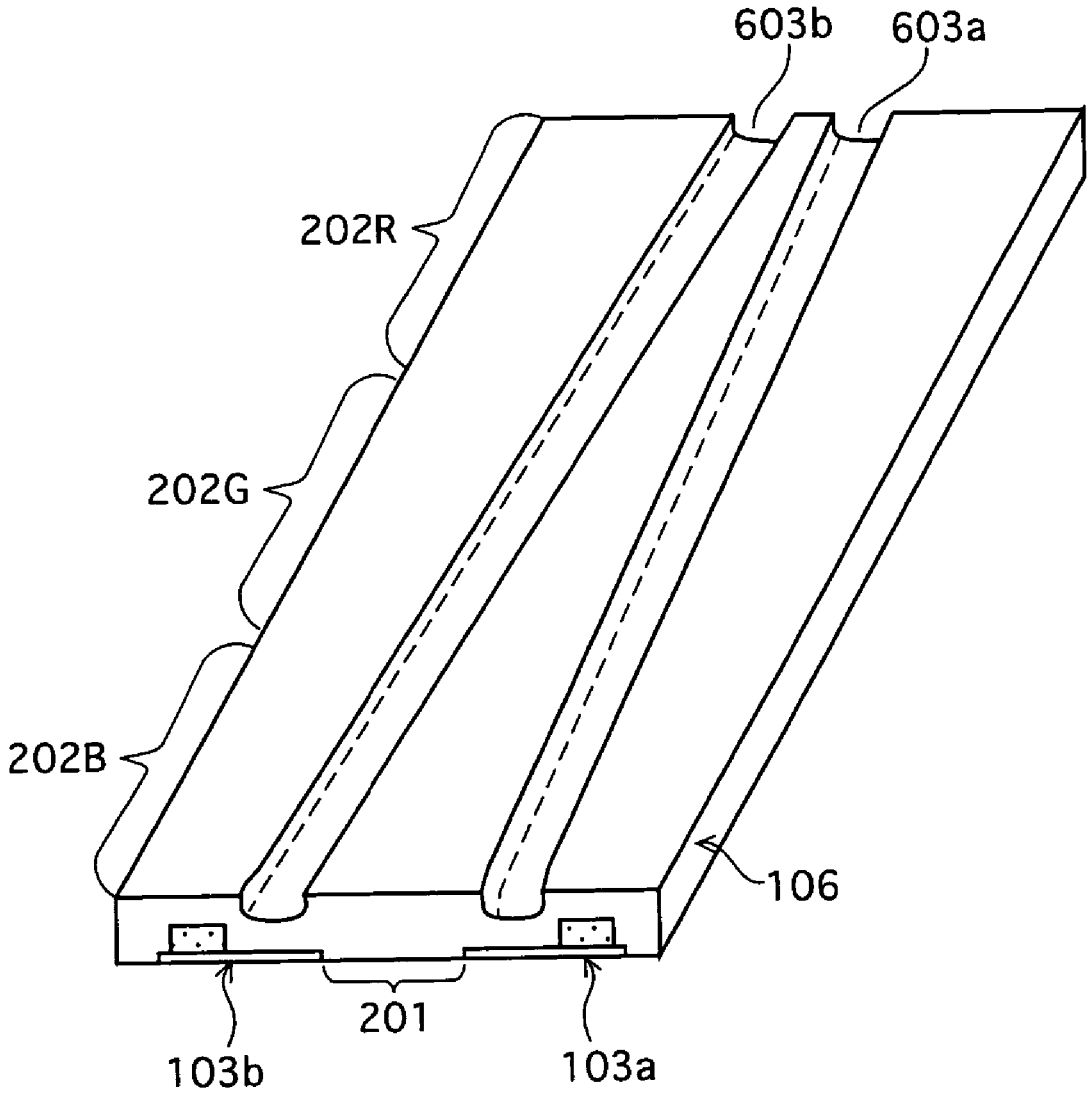
FIG. 8 shows another example where depressions are formed in the dielectric layer differently for discharge cells of different colors of red, green, and blue.

FIG. 8 shows channels 603*a* and 603*b* whose distance in between widens in the order of the red discharge cell 202R, the green discharge cell 202G, and the blue discharge cell 202B.

In this case, the depressions formed by the channels 603*a* and 603*b* are closer to the discharge gap 201 in the red discharge cell 202R, but become more distant from the discharge gap 201 in the order of the green discharge cell 202G and the blue discharge cell 202B.

When the depressions are farther from the discharge gap 201, the spread of discharge that occurs when a voltage is applied between the display electrodes 103*a* and 103*b* is greater. Accordingly, the scale of discharge increases in the order of the discharge cells 202R, 202G, and 202B.

Hence the light emission amount of each color can be balanced in the same way as FIG. 7.

While the forms of the depressions are adjusted so that the spread of discharge increases in the order of red, green, and blue in this embodiment, the order is not limited to such, so long as adjustments are made according to the visible light conversion efficiency of each colored phosphor. Which is to say, the forms of the depressions need be adjusted such that the spread of discharge is greater in a discharge cell of a colored phosphor whose visible light conversion efficiency is lower.

THIRD EMBODIMENT

In the third embodiment, the thickness of the dielectric layer 106 is varied so that the course of light is changed from light blocking regions to light transmitting regions, to improve illumination efficiency.

Generally, visible light that is generated in each discharge cell in a PDP passes through the front panel and is released to the outside. Here, the front panel has transmitting regions that allow visible light to pass through and blocking regions that block visible light from passing through.

Figure 9:
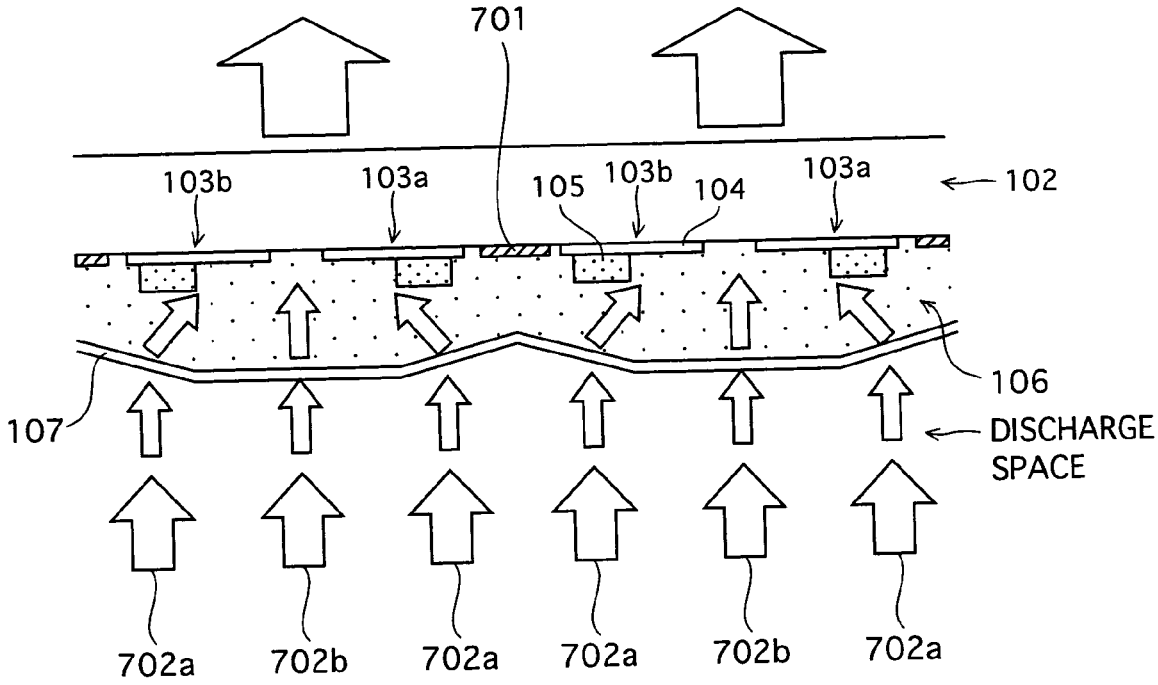
FIG. 9 shows an example where the thickness of the dielectric layer is varied to change the course of light from light blocking regions to light transmitting regions.

In FIG. 9, the blocking regions are regions where the bus electrodes 105 made of opaque metal and black stripes 701 exist, whereas the transmitting regions are the remaining regions.

In the drawing, each hollow arrow represents a flux of visible light that is generated in a discharge cell and passes through the front glass substrate 102 toward the outside.

Here, the surface of the dielectric layer 106 is wound so as to refract light fluxes 702*a* that are directed to the blocking regions (where the bus electrodes 105 and the black stripes 701 are present), to the transmitting regions.

In other words, the dielectric layer 1-06 has a lens form that deflects visible light generated in each discharge cell 202 from a blocking region to a transmitting region.

The protective layer 107 is wound along the surface of the dielectric layer 106, to cover the entire surface of the dielectric layer 106.

If the surface of the dielectric layer 106 is parallel to the front glass substrate 102, the light fluxes 702*a* are blocked by the bus electrodes 105 and the black stripes 701. However, if the light fluxes 702*a* are refracted toward the transmitting regions as above, light is kept from being blocked, with it being possible to improve illumination efficiency.

Method of Manufacturing the PDP

A method of manufacturing the above PDP is described below.

(Manufacture of the Front Panel 101) The manufacture of the front panel 101 is described first. In particular, steps for forming the dielectric layer 106 (a transfer film making step, a transferring step, and a firing step) are described in detail.

(Electrode Forming Step)

A glass plate made using a floating method is used as the front glass substrate 102. The transparent electrodes 104 are formed on this front glass substrate 102 using a typical thin film formation method.

Next, silver electrode precursor layers that are the precursor of the bus electrodes 105 are formed on the transparent electrodes 104, using a silver paste including a silver powder, an organic binder, a glass frit, an organic solvent, and the like.

Here, the silver paste may be applied in the pattern of the bus electrodes 105 using screen printing, and then dried. As an alternative, the silver paste may be applied all over using a method such as screen printing or dye coating and then dried, after which patterning is conducted using photolithography (or lift-off method).

The silver electrode precursor layers may also be formed using a silver electrode transfer film. In this case, the components of the above silver paste are processed in the form of film to produce a silver electrode transfer film, which is then laminated on each transparent electrode 104 to form the silver electrode precursor layers.

Here, the silver electrode precursor layers are fired not in the electrode forming step but in the next dielectric layer forming steps together with a dielectric precursor layer, though it is also possible to fire the silver electrode precursor layers in the electrode forming step before proceeding to the dielectric layer forming steps.

On the other hand, Cr/Cu/Cr electrodes can be formed using a thin film evaporation method.

(Transfer Film Making Step)

A transfer film that includes the dielectric precursor layer is made as follows.

A composite that contains a glass powder, a resin, and a solvent in the form of paste (glass paste composite) is prepared.

The glass powder used here may be $PbO—B_2O_3—SiO_2$, $ZnO—B_2O_3—SiO_2$, $PbO—SiO_2—Al_2O_3$, or $PbO—ZnO—B_2O_3—SiO_2$. It is preferable to use a material whose softening point is around a firing temperature. The resin may be ethyl cellulose or an acrylic resin. The solvent may be n-butyl acetate, BCA, or terpineol.

This glass paste composite is applied onto a support film and then dried. As a result, a transfer film is obtained including a layer of dielectric precursor.

A material used for the support film is preferably a resin that has flexibility. Examples of such a material include polyethylene, polypropylene, polystyrene, polyimide, polyvinyl alcohol, and polyvinyl chloride. The thickness of the support film is, for example, 20 to 1001 μm.

To apply the glass paste composite onto the support film, a roller coater, a blade coater such as a doctor blade, or a curtain coater can be used.

Here, by attaching a cover film made of a flexible resin onto the dielectric precursor layer, it becomes easier to handle the transfer film.

The surfaces of such support film and cover film are preferably subjected to a parting process, to enable them to be easily removed.

(Transferring Step)

The transfer film produced in this way is used to thermally transfer the dielectric precursor layer onto the front glass substrate 102 on which the electrode precursors have been formed in the electrode forming step. Before or after this transfer, impression is performed on the dielectric precursor layer to form depressions.

"To form depressions" here means to vary the layer thickness. Therefore, the formation process includes not only the formation of channels or depressions, but also the texturization and the variation of the layer thickness as is performed in the third embodiment.

The dielectric precursor layer of the transfer film has tackiness like soft clay, and a sufficient shape maintaining ability.

Accordingly, the dielectric precursor layer can be thermally transferred onto the front glass substrate 102 easily by thermocompression bonding. Also, the depressions can be formed by impressing a mold or die having projections onto the dielectric precursor layer.

This impression is performed using a die that has the projections of the same shape as the depressions that are to be formed in the dielectric precursor layer.

It should be noted here that the dielectric precursor layer including the depressions shrinks when fired. The depth of the depressions to be formed in the dielectric precursor layer by impression need be set in consideration of this shrinkage.

Also, by performing the impression on the dielectric precursor layer across the support film, dust can be kept from entering into the dielectric precursor layer during the depression formation.

Also, since the support film has flexibility too, the depressions can be formed in the dielectric precursor layer even when the dielectric precursor layer is pressed cross the support film.

The transfer and the impression are explained in more detail below.

Figure 10A:
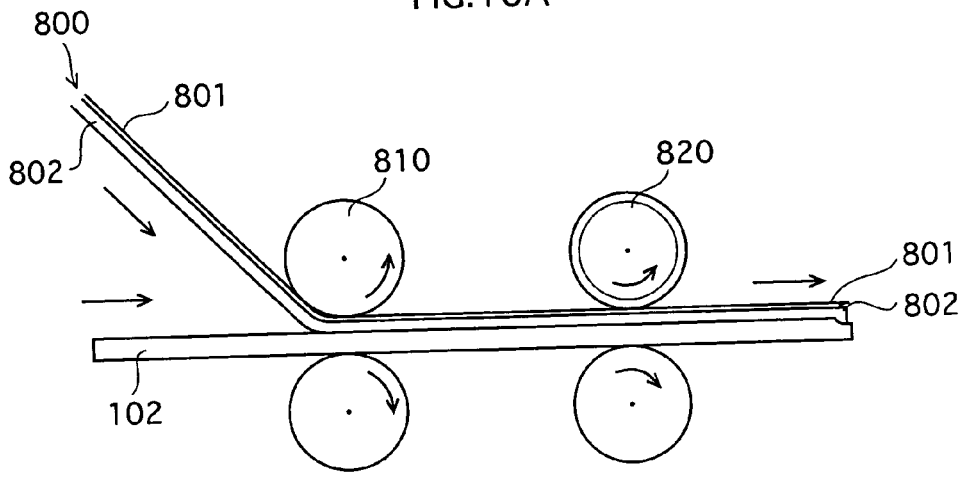
FIGS. 10A and 10B show rough constructions of laminating devices for performing impression and transfer.
Figure 10B:
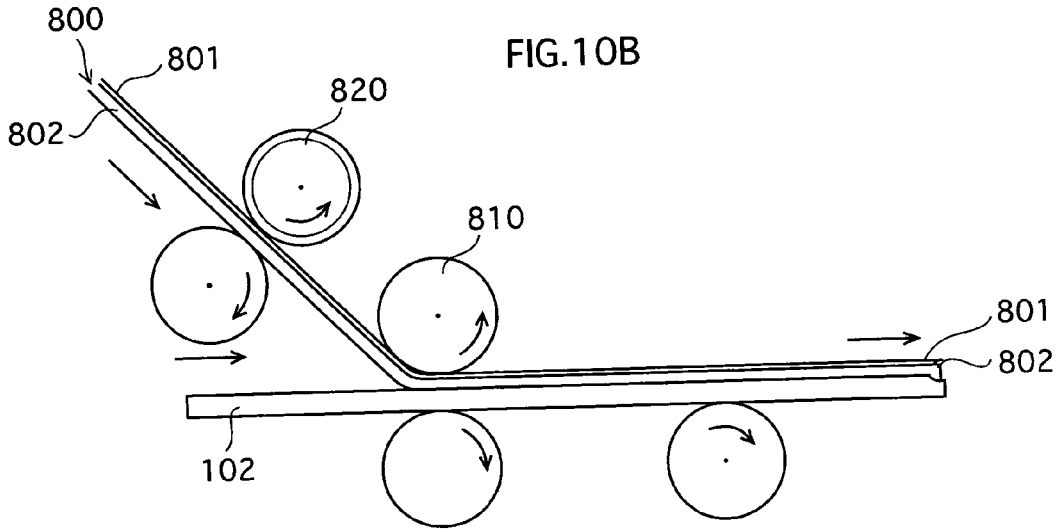

FIGS. 10A and 10B show rough constructions of laminating devices that perform both impression and transfer.

These laminating devices are equipped with an impression roller 820 in addition to a heating roller 810. A transfer film 800 and the front glass substrate 102 on which the electrode precursors have been formed are fed into these devices.

The transfer film 800 is made up of a support film 801 and a dielectric precursor layer 802 which is formed on the support film 801, with a cover film having been removed.

The transfer film 800 is put on the front glass substrate 102 so that the surface of the dielectric precursor layer 802 is in contact with the surface of the front glass substrate 102 on which the electrode precursors have been formed. While doing so, the transfer film 800 is thermocompressed from the support film 801 side using the heating roller 810, to transfer the dielectric precursor layer 802 onto the front glass substrate 102.

As an example, this thermal transfer is conducted under conditions where the heating roller 810 has a surface temperature of 60-120° C., a pressure of 1-5 kg/cm$^2$, and a moving speed of 0.2-10.0 m per minute. Also, the front glass substrate 102 may be preheated at, for instance, 40-100° C.

The laminating device shown in FIG. 10A transfers the dielectric precursor layer 802 onto the front glass substrate 102 using the heating roller 810, and then impresses the impression roller 820 onto the transferred dielectric precursor layer 802, to form the depressions on the surface of the dielectric precursor layer 802. This impression roller 820 need not be heated.

Figure 11:
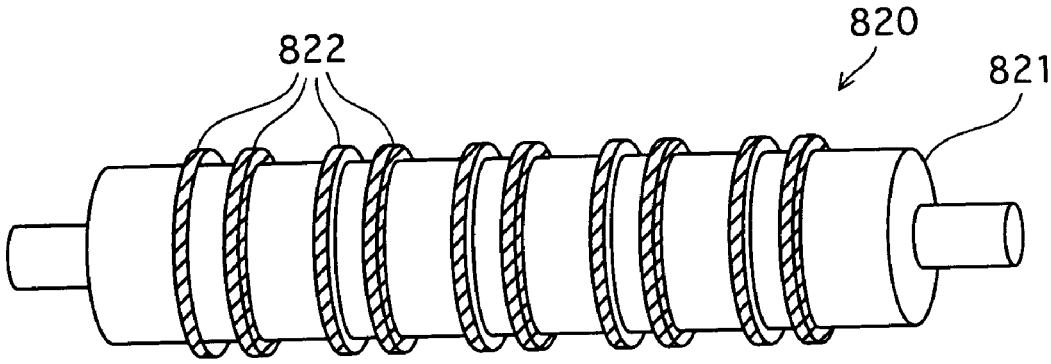
FIG. 11 is a perspective view showing a structure of an impression roller.

As shown in FIG. 11, the impression roller 820 has projections 822 which have the same shape as the depressions to be formed on the surface of the dielectric precursor layer 802.

In the drawing, the ring-shaped projections 822 are formed on the outer surface of a cylindrical roller 821 along the rotating direction. Parallel channels such as those shown in FIG. 5A can be formed using this impression roller 820. However, by curving the projections 822 in an undulating or zigzag form, channels such as those shown in FIGS. 5B and 5C or FIGS. 5D and 5E can be obtained. Also, by forming the projections 822 in isolation for each discharge cell, isolated depressions such as those shown in FIG. 6 can be obtained.

This impression is performed while aligning the positions where the projections 822 press the dielectric precursor layer 802 and the positions of the display electrodes 103*a* and 103*b*, so that the depressions formed in the dielectric precursor layer 802 have a predetermined positional relationship with the display electrodes 103*a* and 103*b*.

When forming the depressions in this way, it is easier in manufacturing to form the channels shown in FIG. 5 than to form the isolated depressions shown in FIG. 6, since the die removal after the depression formation and the alignment are both easier.

The support film 801 can be removed before or after this impression.

For example, the support film 801 may be removed immediately before the next firing step, after the impression roller 820 has been impressed onto the dielectric precursor layer 802 across the support film 801 as shown in FIG. 10A. In such a case, the dielectric precursor layer 802 is protected by the support film 801, with it being possible to keep the dielectric precursor layer 802 from being affected by foreign substances.

As an alternative, the support film 801 may be removed from the dielectric precursor layer 802 transferred on the front glass substrate 102, before the impression roller 820 is impressed on the dielectric precursor layer 802. In this case, the impression is performed directly on the dielectric precursor layer 802 without the support film 801 being interposed as the medium, so that the depressions can be formed more precisely.

On the other hand, the laminating device shown in FIG. 10B sets the impression roller 820 before the heating roller 810, so as to form the depressions in the dielectric precursor layer 802 of the transfer film 800 using the impression roller 820 and then thermally transfer the dielectric precursor layer 802 onto the front glass substrate 102.

When forming the depressions using the impression roller 820 after the dielectric precursor layer 802 is transferred on the front glass substrate 102 as shown in FIG. 10A, it is difficult to form the depressions evenly across the entire surface unless the front glass substrate 102 has a uniform thickness. However, if the depressions are formed over the transfer film 800 using the impression roller 820 before the transfer as shown in FIG. 10B, it is possible to form the depressions evenly even when the thickness of the front glass substrate 102 is not uniform.

While the impression roller 820 is equipped in the laminating device in the above examples, the present invention is not limited to such. For example, the depressions may be formed in advance in the transfer film 800 using the impression roller 820, so that the transfer film having the depressions is fed into the laminating device and thermally transferred onto the front glass substrate 102.

The following methods may also be used to form the depressions in the dielectric precursor layer in the transferring step.

In the laminating devices of FIGS. 10A and 10B, the heating roller 810 and the impression roller 820 are separately provided. However, the projections may be formed on the heating roller itself to enable the heating roller to serve as an impression roller.

Also, instead of forming the depressions in the dielectric precursor layer in the transferring step, the depressions may be formed when the support film is removed immediately before the dielectric precursor layer is fired, as explained later.

The above examples form the depressions in the dielectric precursor layer using the impression roller. However, the depressions may also be formed using a flat-shaped die, though it is easier to use the impression roller considering the fact that the transfer film is continuously fed into the laminating device to form the depressions in sequence. Besides, when the impression roller is used, the depressions can be formed with uniform depth even if the thickness of the front glass substrate 102 or dielectric precursor layer is uneven.

(Firing Step)

The front glass substrate 102 on which the dielectric precursor layer 802 provided with the depressions has been arranged is put in a firing furnace and fired.

Here, if the support film 801 covers the dielectric precursor layer 802, a device for removing the support film 801 (support film peeler) need be provided at the entrance of the firing furnace, so as to remove the support film 801 before firing the construction in the firing furnace.

In the firing furnace, the front glass substrate 102 is left standing for several minutes to several tens of minutes, at a temperature not lower than the softening temperature of the glass component included in the electrode precursors and dielectric precursor layer. After this, the temperature is decreased. In so doing, the electrode precursors change to the electrodes, and the dielectric precursor layer to the dielectric layer.

As a result, the dielectric layer 106 having the depressions is formed on the front glass substrate 102.

(Protective Layer Forming Step)

The protective layer 107 made of MgO is formed on the dielectric layer 106 using a method such as electron beam evaporation, so as to cover even the inner walls of the depressions in the dielectric layer 106.

This completes the front panel 101.

(Manufacture of the Back Panel 111)

A paste for silver electrodes is applied on the back glass substrate 112 using screen printing or the like and then fired, to form the address electrodes 113. A dielectric paste is applied on the back glass substrate 112 on which the address electrodes 113 have been arranged using screen printing or the like and then fired, to form the dielectric layer 114.

After this, the barrier ribs 115 are formed on the dielectric layer 114. The barrier ribs 115 can be formed by screen-printing a glass paste for barrier ribs and then firing the result, or by applying the glass paste all over and drying it before performing photolithography and sandblasting.

Following this, phosphor pastes (or phosphor inks) of red, green, and blue are prepared and applied between adjacent barrier ribs 115, and the result is fired in the air to form the phosphor layers 116 of the three colors. This completes the back panel 111.

The front panel 101 and the back panel 111 manufactured in the above way are placed one on top of the other so that the display electrodes 103*a* and 103*b* cross over the address electrodes 113, and sealed together along their edges using a sealing member. The inner spaces partitioned by the barrier ribs 115 are evacuated. After this, a discharge gas such as Ne—Xe is enclosed in the inner spaces. Hence the PDP is completed.

(Effects Achieved by the Manufacturing Method of the Present Invention)

According to the above manufacturing method, by changing the shape of the projections on the impression roller 820, depressions such as those shown in FIGS. 5-8 or texture structures such as those shown in FIGS. 3 and 4 can be formed in the dielectric layer. It is also possible to change the thickness of the dielectric layer as shown in FIG. 9.

In particular, texturization can be easily performed by the impression method that uses the impression roller.

Also, according to the impression method, depressions of any shape other than those shown in FIGS. 3-8 can be formed in the dielectric layer. In addition, the number of depressions in each discharge cell is not limited to two, as any number of depressions can be formed using the impression method.

As explained above, according to the manufacturing method of the present invention, depressions can be formed on the surface of the dielectric layer with relatively few manufacturing steps and high yields.

To vary the thickness of the dielectric layer, there is a method of applying a dielectric glass paste uniformly over the entire surface and then applying, using screen printing or the like, the same dielectric glass paste in pattern to the areas other than the areas where the depression are to be formed.

However, this method requires two applications of dielectric glass paste, which increases costs.

Besides, when forming the pattern using screen printing, the shapes of the depressions change due to the expansion and deterioration of a screen, or a variation occurs in the application state of the glass paste due to the changes in properties of the glass paste. This decreases yields.

To form the depressions in the dielectric layer, there is also a method of patterning the dielectric precursor layer by removing the parts of the dielectric precursor layer where the depressions should be formed, during development using photolithography. However, it is difficult to remove fine parts by development, with there being difficulties in precisely forming texture structures or isolated depressions such as those shown in FIG. 6. This tends to result in manufacturing failures.

With the manufacturing method of the present invention, on the other hand, the application of the dielectric glass paste composite need not be performed more than once. Also, depressions of uniform shape can be formed by impression. This contributes to higher yields. Furthermore, fine depressions can be formed with relative precision, which further contributes to higher yields.

Thus, PDPs whose dielectric layers are provided with depressions can be manufactured at relatively low cost.

(Modifications to the Method of Forming the Depressions in the Dielectric Precursor layer)

The above example describes the case where the impression roller is provided in the laminating device for transferring the transfer film onto the substrate, with the depressions being formed in the dielectric precursor layer using this impression roller. However, the following methods may instead be used to form the depressions in the dielectric precursor layer.

The impression roller may be provided in a device other than the laminating device, to form the depressions in the dielectric precursor layer.

Which is to say, the depressions do not need to be formed in the dielectric precursor layer in the transferring step. Instead, the impression roller may be provided in the peeling device used in the firing step, so that the depressions are formed in the dielectric precursor layer using the impression roller immediately before or after the support film is removed from the dielectric precursor layer which has been transferred on the substrate.

INDUSTRIAL APPLICABILITY

The PDP of the present invention can be used for display devices in computers, televisions, and the like. The PDP of the invention is particularly suitable for large display devices.

The invention claimed is:

1. A plasma display panel comprising:

a first panel including a first substrate, a display electrode pair formed on a surface of the first substrate, and a dielectric layer formed on the surface of the first substrate so as to cover the display electrode pair; and a second panel including a second substrate and phosphor layers formed on a surface of the second substrate, wherein the first panel and the second panel are set so that the surface of the first substrate on which the display electrode pair and the dielectric layer have been formed faces the surface of the second substrate on which the phosphor layers have been formed, with a plurality of discharge cells being formed between the first panel and the second panel along the display electrode pair, wherein a surface of the dielectric layer facing the second panel has at least two depressions which include a first depression and a second depression that are not connected to each other, in an area that corresponds to each discharge cell, wherein, when the first panel is viewed in a direction perpendicular to its surface, the first depression and the second depression are each shaped like one of U and a V, and the first depression and the second depression are positioned with open ends or closed ends thereof facing each other.

2. A plasma display panel comprising:

a first panel including a first substrate, a display electrode pair formed on a surface of the first substrate, and a dielectric layer formed on the surface of the first substrate so as to cover the display electrode pair; and a second panel including a second substrate and phosphor layers formed on a surface of the second substrate, wherein the first panel and the second panel are set so that the surface of the first substrate on which the display electrode pair and the dielectric layer have been formed faces the surface of the second substrate on which the phosphor layers have been formed, with a plurality of discharge cells being formed between the first panel and the second panel along the display electrode pair, wherein a surface of the dielectric layer facing the second panel has at least two depressions which include a first depression and a second depression that are not connected to each other, nor separated by a barrier wall in an area that corresponds to each discharge cell, the first depression and the second depression are separated on opposite sides of a center line of the discharge cell, the center line running along and being positioned between the display electrode pair, and the first depression and the second depression are isolated from other first and second depressions provided in other discharge cells, wherein the first depression and the second depression are closer to each other in a vicinity of a center of the discharge cell, and are farther from each other as the first depression and the second depression become more distant from the center of the discharge cell in a direction along the display electrode pair.

3. A plasma display panel comprising:

a first panel including a first substrate, a display electrode pair formed on a surface of the first substrate, and a dielectric layer formed on the surface of the first substrate so as to cover the display electrode pair; and a second panel including a second substrate and phosphor layers formed on a surface of the second substrate, wherein the first panel and the second panel are set so that the surface of the first substrate on which the display electrode pair and the dielectric layer have been formed faces the surface of the second substrate on which the phosphor layers have been formed, with a plurality of discharge cells being formed between the first panel and the second panel along the display electrode pair, wherein a surface of the dielectric layer facing the second panel has at least two depressions which include a first depression and a second depression that are not connected to each other, in an area that corresponds to each discharge cell, the first depression and the second depression are separated on opposite sides of a center line of the discharge cell, the center line running along and being positioned between the display electrode pair, and the first depression and the second depression are isolated from other first and second depressions provided in other discharge cells, wherein each discharge cell corresponds to a phosphor layer of a color selected from a plurality of colors, and the first depression and the second depression have a shape that differs according to the color of the phosphor layer corresponding to the discharge cell.

4. The plasma display panel of claim 3, wherein the plurality of colors include red, green, and blue, and a total area of the first depression and the second depression increases in an order of red, green, and blue.

5. The plasma display panel of claim 3, wherein the plurality of colors include red, green, and blue, and a distance between the first depression and the second depression increases in an order of red, green, and blue.

6. A plasma display panel comprising:

a first panel including a first substrate, a display electrode pair formed on a surface of the first substrate, and a dielectric layer formed on the surface of the first substrate so as to cover the display electrode pair; and a second panel including a second substrate and phosphor layers formed on a surface of the second substrate, wherein the first panel and the second panel are set so that the surface of the first substrate on which the display electrode pair and the dielectric layer have been formed faces the surface of the second substrate on which the phosphor layers have been formed, with a plurality of discharge cells being formed between the first panel and the second panel along the display electrode pair, wherein a surface of the dielectric layer facing the second panel has a mat texture structure in a plurality of depressions in an area that corresponds to each discharge cell, the mat texture structure containing pyramidal projections and sub-depressions between the pyramidal projections.

7. A plasma display panel comprising:

a first panel including a first substrate, a display electrode pair formed on a surface of the first substrate, and a dielectric layer formed on the surface of the first substrate so as to cover the display electrode pair; and a second panel including a second substrate and phosphor layers formed on a surface of the second substrate, wherein the first panel and the second panel are set so that the surface of the first substrate on which the display electrode pair and the dielectric layer have been formed faces the surface of the second substrate on which the phosphor layers have been formed, with a plurality of discharge cells being formed between the first panel and the second panel along the display electrode pair, wherein a first channel and a second channel that extend over the plurality of discharge cells are formed on a surface of the dielectric layer facing the second panel, along the display electrode pair, and a part of the first channel and a part of the second channel form at least two depressions which include a first depression and a second depression, in an area that corresponds to each discharge cell, wherein a width of the first channel and a width of the second channel are each less than a width of one of the display electrode pair.

* * * * *